United States Patent [19]

Griffin

[11] 4,075,969

[45] Feb. 28, 1978

[54] AUXILIARY WATER SYSTEM FOR OUTBOARD MOTOR

[76] Inventor: Edward R. Griffin, 415 Hereford Drive, Brookshire, Tex. 77423

[21] Appl. No.: 769,262

[22] Filed: Feb. 16, 1977

[51] Int. Cl.[2] ..... B63H 5/13

[52] U.S. Cl. ..... 115/17; 115/75

[58] Field of Search ..... 115/17, 18 R, 75, 34 R; 114/185, 183 R; 123/41.01

[56] References Cited

U.S. PATENT DOCUMENTS

| | | | |
|---|---|---|---|
| 1,099,684 | 6/1914 | Barlow et al. | 115/75 |
| 1,481,112 | 1/1924 | Toennes | 115/17 |
| 1,716,962 | 6/1929 | Johnson | 115/18 R |
| 3,240,181 | 3/1966 | Chandler et al. | 115/17 |

*Primary Examiner*—Trygve M. Blix
*Assistant Examiner*—Jesus D. Sotelo
*Attorney, Agent, or Firm*—Vinson & Elkins

[57] ABSTRACT

A cooling water system adapted to be used with an outboard motor when its water pump has failed which system includes a conduit adapted to have one end connected to one of the two water outlets adjacent the portion of the motor above the shaft housing of an outboard motor, and an enlarged inlet secured to the other end of the conduit said enlarged inlet being releasably connected to the lower portion of the shaft housing so that it faces forward to receive water flow responsive to movement of the motor through the water.

8 Claims, 3 Drawing Figures

AUXILIARY WATER SYSTEM FOR OUTBOARD MOTOR

BACKGROUND OF THE INVENTION

Outboard motors generally include a water pump to pump water from the lower portion of the shaft housing, through the water jacket surrounding the cylinder and out the water discharge. When the water pump in an outboard motor fails, continued operation of the motor results in overheating and possible damage to the motor. Thus, failure of the water pump can mean that the boat on which it is used is stranded.

Efforts have been made to provide an auxiliary water cooling system for an outboard motor to avoid the use of the motor without cooling. One example of an auxiliary water cooling system, as shown in U.S. Pat. No. 3,240,181 involves the use of a forward facing scoop connected by a tube 42 to a plate secured over the water inlet in the lower portion of the shaft housing. Installation of this device involves the attachment of the plate to the lower portion of the shaft housing by screws which is difficult in the water. Also, this hose structure must support the scoop and a U-bend in a position immediately behind the propeller with only its connection to the plate and a single support strut connecting to the hose ahead of the U-bend and the scoop. Such structure is expensive because it requires heavy construction or be subject to failure due to the extremely high loading resulting from the movement of the scoop through the water. Also, it does not by-pass the water pump and the water passages in the shaft housing. Similar scoops permanently installed have been used as a water cooling system for inboard motors as evidenced by U.S. Pat. No. 1,099,684.

SUMMARY

The present invention relates to an auxiliary, portable water cooling system for an outboard motor. It includes a conduit adapted to be connected to one of the water outlets adjacent the water jackets of the cylinders, scoop connected to the opposite end of the conduit and a means for connecting and retaining the scoop in the water near the lower end of the motor shaft housing.

An object of the present invention is to provide an improved auxiliary cooling water system for an outboard motor which may be quickly and easily installed.

Another object is to provide an improved auxiliary cooling water system for an outboard motor which conducts cooling water directly to the water jacket and by-passes the water pump and waterlines in the shaft housing.

A further object is to provide an improved auxiliary cooling water system for an outboard motor which will withstand substantial speed of the motor through the water without problems.

BRIEF DESCRIPTION OF THE DRAWINGS

These and other objects and advantages of the present invention are hereinafter explained and discussed with reference to the drawings wherein.

DESCRIPTION OF THE PREFERRED EMBODIMENT

Figure 1:
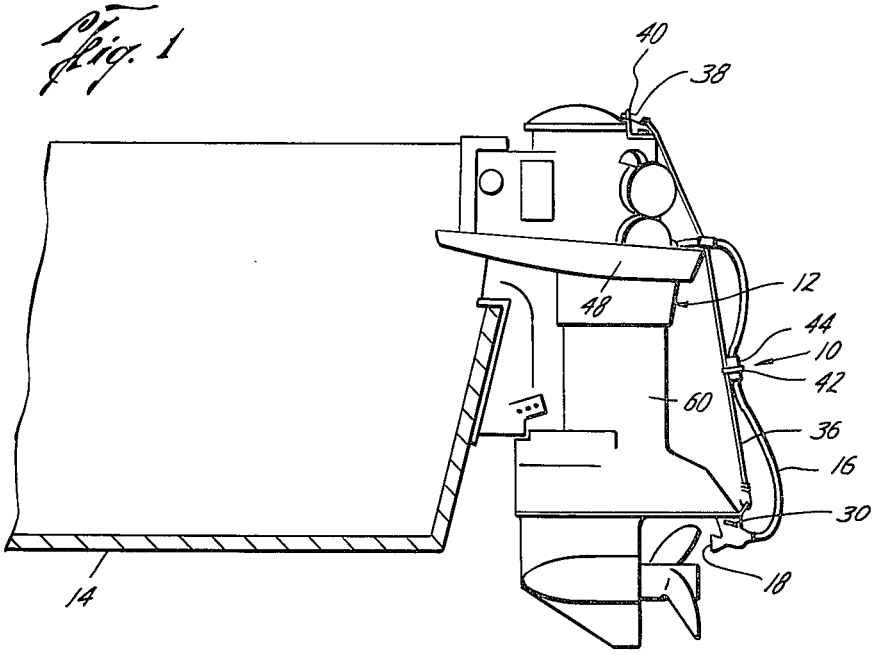
FIG. 1 is a side elevation view of an outboard motor on the stern of the boat (shown in section) with the improved auxiliary cooling water system of the present invention installed thereon.
Figure 2:
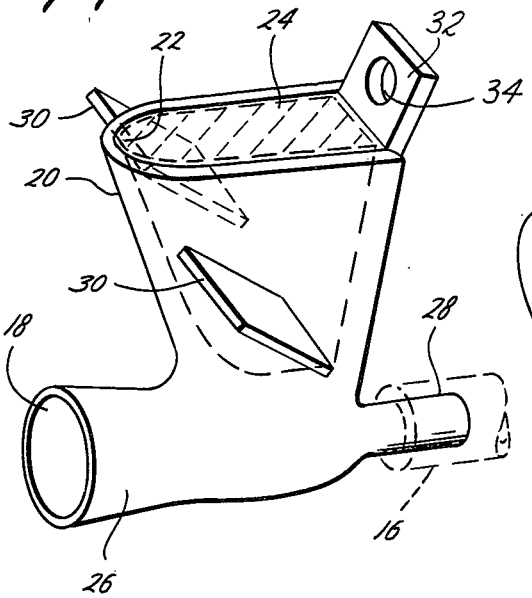
FIG. 2 is a perspective view of the enlarged end and connecting fixture of the present invention.

The improved auxiliary cooling water system 10 of the present invention is shown in operative position on the outboard motor 12 which is secured to the transom of the boat 14, a portion of which is omitted. The system 10 includes the conduit or hose 16, the enlarged end or scoop 18 and the means for connecting and retaining the system in operative position on the motor 12. The element 20 defines the scoop 18 and the pocket or recess 22 which is adapted to receive the motor trim tab 24 (shown in phantom section in FIG. 2). The passage 26 gradually narrows and exits through the nipple 28 to which the hose 16 is connected. Thus, water entering scoop 18 flows through passage 26 and into hose 16 through nipple 28.

Figure 3:
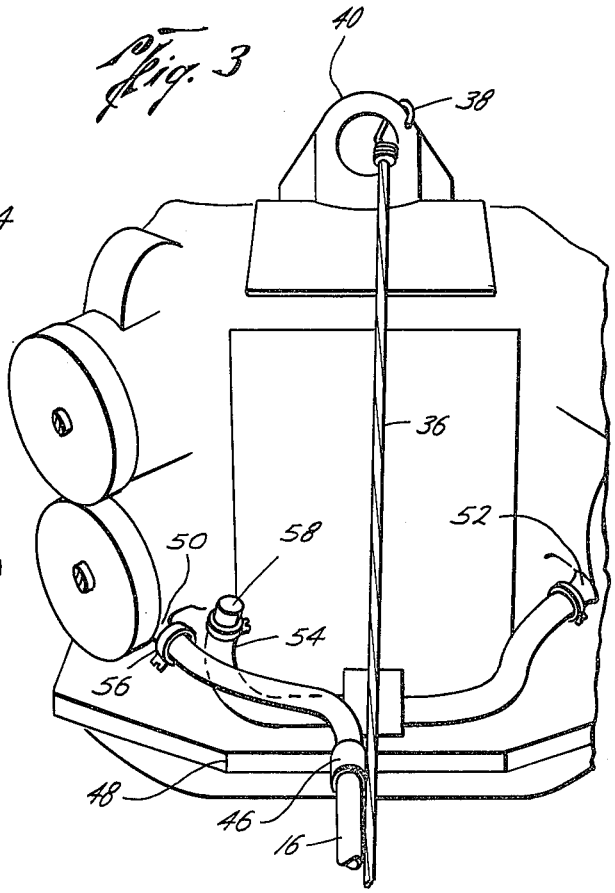
FIG. 3 is a perspective view of the connection of the improved auxiliary cooling water system to the water jacket of an outboard motor.

The element 20 includes the fins or vanes 30 which are tilted upward in the forward direction. The flow of water over the vanes 30 creates an upward force to retain the element 20 on the trim tab 24. It is preferred that vanes 30 be positioned as far forward as possible so that the upward forces created by the vanes responsive to movement through water are sufficiently forward to retain the element 20 on the trim tab 24. The lug 32 extends upward and rearward from the rear end of recess 22 and includes an opening 34 to which the resilient element or elastic cord 36 is attached. The other end of cord 36 includes the hook 38 which is secured to the lift bracket 40 on the motor 12, as best seen in FIG. 3. Cord 36 should be stretched so that it exerts an upward force on element 20 to retain it in position.

The sleeve 42 engages around cord 36 and is integral with sleeve 44 which surrounds hose 16. The sleeves 42 and 44 provide a support for the intermediate portion of hose 16. Another sleeve 46 is slidable on hose 16 and is intended to be positioned to engage the corner of motor housing 48 to protect hose from such corner.

The upper end of hose 16 is connected to one of the water exhaust nipples 50 and 52 which extend from the motor water jacket. This connection, as shown in FIG. 3, is made to the nipple 50 by removing its hose 54 therefrom, connecting hose 16 thereon securing hose 16 in position with hose clamp 56 and suitably closing the disconnected end of hose 54 such as with the plug 58.

With the improved system of the present invention connected as shown in the drawings, the motor 12 may be started and the flow of water enters the scoop 18 and is conducted to the outlet nipple 50. The water flows completely through the cooling jacket of the motor 12 and exhausts through nipple 52 and the usual water exhaust system.

As can be seen, the improved cooling water system of the present invention picks up water responsive to the flow of water past the trim tab 24 and delivers such water directly to the water jacket of the motor 12 by-passing the water pump and the inlet water lines in the shaft housing 60.

The improved auxiliary cooling water system of the present invention has been installed on a standard outboard motor with the water pump being inoperative and the motor run to drive a boat approximately twenty miles without any overheating of the motor. On one occasion, the head of such motor was sufficiently cool after running this distance to be felt by an individual's hand without burning.

The system is simple in construction, may be easily installed by placing element pocket 22 over the trim tab 24, connecting the cord 36 and the hose 16 and plugging the exhaust hose 54. The element 20 is held in place by the force of the elastic cord 36 and the lifting force on the vanes 30 when the water is flowing thereby. The components may be stored in a small space and are immediately available for installation. Only simple tools, such as a screwdriver for the hose clamp 56, are used in the installation of the unit.

What is claimed is:

1. An auxiliary water cooling system for an outboard motor having a pair of water outlets from the water jacket comprising an element defining a scoop, a nipple, a passage extending from said scoop to said nipple, and a recess of sufficient size to receive a motor trim tab, a hose secured to said nipple, means for securing the other end of the hose to one of the water outlets, and an elastic cord connecting to said element and having means for connecting to the lifting bracket for an outboard motor to connect and retain the element in engagement with the trim tab whereby said scoop is below the water level and facing the direction in which the motor is moving through the water.

2. An outboard motor, comprising an internal combustion engine with a drive shaft, a propeller connected to be driven by said drive shaft, a drive shaft housing surrounding said drive shaft and having a trim tab on the lower end thereof, said engine having a water jacket for water cooling of said engine and a pair of water ports connecting into said water jacket, an element defining a water scoop and a recess adapted to receive said trim tab, means retaining said element in position with said trim tab in said recess and said water scoop below water level in a forward facing position, a hose connecting from said scoop to one of said water jacket ports to conduct cooling water to said water jacket, and means connecting to the other of said water jacket ports to discharge the cooling water from said engine.

3. An auxiliary cooling water system for an outboard motor having a pair of water outlets from the water jacket, comprising a conduit, means for connecting one end of said conduit to one of said water outlets on said motor, an element defining a scoop connecting as the inlet for the other end of said conduit, said element defining a recess to receive the trim tab of said motor, and an elastic cord connecting from said element to the upper portion of said motor and retaining said element with its scoop facing in the direction of movement of the motor through the water and at a level below the surface of the water.

4. A system according to claim 3 wherein said element includes means for exerting an upward force on said element responsive to the flow of water past said element to assist in retaining said element in engagement with said trim tab.

5. A system according to claim 3 including a sleeve structure mounted on said elastic cord and said conduit to support said conduit.

6. A system according to claim 3 including sleeve means on said conduit and engaging the corner of the motor housing for protecting said conduit from damage.

7. An auxiliary cooling water system for an outboard motor having a water jacket and a pair of ports communicating therewith, comprising a conduit, an element defining a scoop and a recess, means for connecting said conduit to said element whereby said scoop provides the inlet to said conduit, means connecting said conduit to one of said water jacket ports, said recess adapted to receive a portion of the motor therein to position said scoop underwater facing in the direction of movement of the motor through the water, and means for retaining said element in position with the portion of said motor received within said recess.

8. A system according to claim 7 including means for plugging the unconnected end of the exhaust hose normally connecting to the water outlet to which said conduit is connected.

* * * * *